US007507076B2

(12) United States Patent
McLeod

(10) Patent No.: US 7,507,076 B2
(45) Date of Patent: Mar. 24, 2009

(54) KNOCKDOWN PUMP CONTAINMENT ASSEMBLY APPARATUS AND METHOD

(76) Inventor: David J. McLeod, American Spray Technologies, 1502 22nd St. NW., Auburn, WA (US) 98001

( * ) Notice: Subject to any disclaimer, the term of this patent is extended or adjusted under 35 U.S.C. 154(b) by 802 days.

(21) Appl. No.: 11/025,321

(22) Filed: Dec. 20, 2004

(65) Prior Publication Data

US 2005/0133625 A1 Jun. 23, 2005

Related U.S. Application Data

(60) Provisional application No. 60/531,287, filed on Dec. 19, 2003.

(51) Int. Cl.
*F04B 17/00* (2006.01)
*F01C 1/10* (2006.01)

(52) U.S. Cl. ..... 417/360; 418/48

(58) Field of Classification Search ..... 417/234, 417/360, 900; 418/48
See application file for complete search history.

(56) References Cited

U.S. PATENT DOCUMENTS

| | | | | |
|---|---|---|---|---|
| 2,815,767 | A | 12/1957 | Kurns | |
| 2,820,627 | A | 1/1958 | Arce et al. | |
| 3,079,050 | A | 2/1963 | Wahl | |
| 3,716,066 | A | 2/1973 | Currier et al. | |
| 3,889,850 | A | 6/1975 | Whitt | |
| 4,278,279 | A | 7/1981 | Zimmerman | |
| 4,669,961 | A | 6/1987 | Lorett | |
| 4,818,197 | A * | 4/1989 | Mueller | 418/48 |
| 4,848,659 | A | 7/1989 | Tadych | |
| 5,067,856 | A | 11/1991 | Sisk | |
| 5,314,100 | A | 5/1994 | Deaver | |
| 5,639,227 | A | 6/1997 | Mills | |
| 5,722,820 | A | 3/1998 | Wild et al. | |
| 5,769,618 | A | 6/1998 | Ono et al. | |
| 5,967,426 | A | 10/1999 | McLeod | |
| 6,764,284 | B2 * | 7/2004 | Oehman, Jr. | 417/360 |
| 6,877,967 | B2 * | 4/2005 | Gantenhammer | 418/48 |

* cited by examiner

*Primary Examiner*—Charles G Freay
(74) *Attorney, Agent, or Firm*—William Forster

(57) ABSTRACT

A knockdown pump containment assembly for supporting a stator that employs a rotor therein. The pump containment assembly comprises a removable pump housing that defines a containment chamber for receiving, containing and directing the flow of a liquid material. The pump housing also includes an inlet port disposed for directing the flow of liquid material into the containment chamber, and an exit port for directing the flow of liquid material out of the containment chamber, into a stator. The pump containment assembly also includes a pump housing base provided for releasably receiving and supporting portions of the pump housing, and a pump housing retainer designed to releasably engage with the pump housing base to releasably secure the pump housing to the pump housing base.

17 Claims, 7 Drawing Sheets

KNOCKDOWN PUMP CONTAINMENT ASSEMBLY APPARATUS AND METHOD

This application claims the benefit of U.S. Provisional Application No. 60/531,287 filed Dec. 19, 2003.

BACKGROUND

This invention relates generally to portable spray equipment for applying texture and acoustic materials to surfaces, and more particularly to mechanically driven progressive cavity pumps, and assemblies thereof, for pumping such texture and acoustic materials.

Pumping systems for pumping heavy viscous liquids and materials are well known and have been employed for such purposes for many years. In smaller, more portable spray equipment, progressive cavity type pumps are sometimes employed. Because liquid texture materials tend to set-up and harden quickly, frequent cleaning of the pump components is required. Accordingly, the ease of such cleaning becomes an important factor.

One example of texture spray equipment is illustrated in U.S. Pat. No. 5,769,618 issued in 1998. That reference discloses a uniaxial screw pump, of the progressive cavity type, that incorporates a somewhat intricate structure that is bulky and difficult to dissemble clean.

In addition, in 1999, U.S. Pat. No. 5,967,426 issued disclosing a portable spray system that employed a progressive cavity pump in combination with a pump housing that is bolted to a drive mechanism. Although, this design is well suited for the kind of use noted above, the '426 pumping unit has interior regions that are somewhat hard to reach and therefore require more time for a complete disassembly and cleaning.

Accordingly, a need remains for a liquid pump for use in texture spray equipment where the design of the pump, and the components thereof, promotes quick break-down and set-up, easy disassembly, where all interior regions of the pump are readily accessible, and where the pump employs interchangeable parts for quick, inexpensive repair.

SUMMARY

One object of the present invention is to enable an operator to easily break-down and disassemble the spray equipment for quick and complete cleaning of the components that come in contact with the liquid spray material.

A second object is to reduce the time required to clean the internal texture spray pump components in preparation for further cycles of use.

A third object is to increase the number of applications an operator can execute in a specified period of time.

Another object is to reduce the cost of operating texture spray equipment.

Yet another object is to enable an operator to easily interchange parts between spray equipment.

A further object is to enable an operator to easily inspect and replace worn parts in the spray equipment.

Still another object is to increase the reliability of texture spray equipment.

The invention is a knockdown pump containment assembly for use with a common off-the-shelf, readily available stator that employs a rotor therein. The pump containment assembly is adapted to receive a drive shaft assembly that is mechanically driven by a drive mechanism, such as an electric motor. Such a motor is selected to supply a rotational driving force which is transferred to the rotor for pumping heavy liquid material through the stator. For this purpose, the pump containment assembly comprises a removable pump housing that defines a containment chamber for receiving, containing and directing the flow of a liquid material. Moreover, the pump housing includes an inlet port disposed for directing the flow of liquid material into the containment chamber, and an exit port for directing the flow of liquid material out of the containment chamber, into a stator. It should be noted that the containment chamber of the pump housing is adapted to receive a drive shaft assembly therein.

The pump containment assembly also comprises a pump housing base for releasably receiving and supporting portions of the pump housing. The pump housing base is adapted to engage a drive mechanism, such as a motor or a gear reducer/transmission mounted to a motor, that supplies a driving force to the drive shaft assembly disposed within the containment chamber.

Further, the pump containment assembly also comprises a pump housing retainer designed to releasably engage with the pump housing base to releasably secure the pump housing to the pump housing base. For that purpose, the pump housing base includes a coupling seat adapted for mounting to a drive mechanism, and a base frame that extends outward from the coupling seat, to a retainer mounting portion thereof that receives and releasably fixes the pump housing retainer to the pump housing base.

The foregoing and other objects, features, and advantages of this invention will become more readily apparent from the following detailed description of a preferred embodiment which proceeds with reference to the accompanying drawings, wherein the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention.

DETAILED DESCRIPTION OF PREFERRED EMBODIMENT

Figure 1:
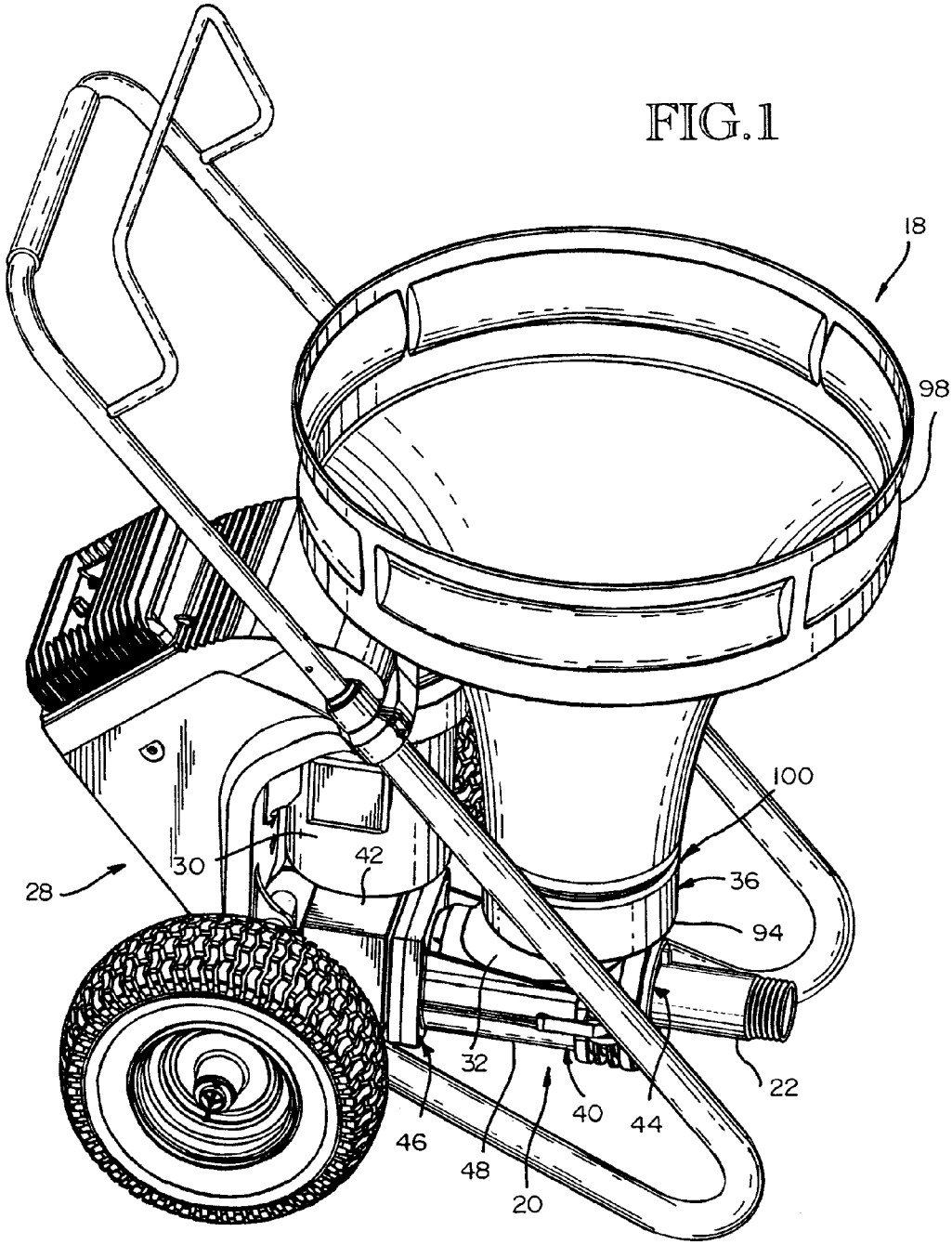
FIG. 1 is a perspective view of a spray system that incorporates a pump containment assembly in accordance with the present invention.

FIGS. 1 through 7 show a knockdown pump containment assembly 20 in accordance with the present invention. The invention is a knockdown pump containment assembly 20 for use in a spray system 18 for pumping heavy liquid materials. The pump containment assembly 20 supports a common "off-the-shelf" stator 22 that includes a rotor 24 therein. The pump containment assembly 20 is adapted to receive a drive shaft assembly 26 that is mechanically driven by a drive mechanism 28, such as an electric motor 30. Such a motor 30 is selected to supply a rotational driving force which is transferred to the rotor 24 for pumping heavy liquid material (not illustrated) through the stator 22. For this purpose, the pump containment assembly 20 comprises a removable pump housing 32 that defines a containment chamber 34 for receiving, containing and directing the flow of a liquid material. Moreover, the pump housing 32 includes an inlet port 36 disposed for directing the flow of liquid material into the containment chamber 34, and an exit port 38 for directing the flow of liquid material out of the containment chamber 34, into a stator 22. It should be noted that the containment chamber 34 of the pump housing 32 is adapted to receive a drive shaft assembly 26 therein.

The pump containment assembly 20 also comprises a pump housing base 40 for releasably receiving and supporting portions of the pump housing 32. The pump housing base 40 is adapted to engage a drive mechanism 28, such as an electric motor 30 or a gear reducer type transmission 42 mounted to a motor, that supplies a driving force to the drive shaft assembly 26 disposed within the containment chamber 34.

Further, the pump containment assembly 20 also comprises a pump housing retainer 44 designed to releasably engage with the pump housing base 40 to releasably secure the pump housing 32 to the pump housing base 40. For that purpose, the pump housing base 40 includes a coupling seat 46 which defines a flange 53 adapted for mounting to a drive mechanism 28. Accordingly, a plurality of bores 51 are provided to enable a bolted connection between the flange 53 and the gear reducer/transmission 42. Additionally, the pump housing base 40 includes a base frame 48 that extends outward from the coupling seat 46, to a retainer mounting portion 50 thereof that receives and releasably fixes the pump housing retainer 44 to the pump housing base 40. In this way the pump housing 32 is secured to the pump housing base 40. As will be discussed more fully in the following, the pump housing 32 is secured to the pump housing base 40 between the coupling seat 46 and the pump housing retainer 44.

Considering now in more detail the components and structure of a pump containment assembly 20, a pump housing base 40 is constructed in one piece to include a base frame 48 that extends from a coupling seat 46 to a retainer mounting portion 50. In the present invention, the coupling seat 47 is a mounting plate 52 having a centrally disposed bore 54 which is provided to receive a drive shaft assembly 26 therethrough. In addition, the mounting plate 52 defines a flange 53 having a plurality of bores 51 so that a plurality of bolts 55 can fix the pump housing base 40 to a drive mechanism 28. For this purpose a gasket 57, and a spacer plate 59 are provided to ensure a proper fit to the drive mechanism 28 which might include a right angle type transmission 42.

In order to extend a drive shaft assembly from the transmission 42, a centrally disposed circular groove 56 is formed in the mounting plate 52 which provides a pump housing seat 58. In this way, a drive shaft aperture 60 can be formed in the pump housing 32 so that portion of the pump housing 32 will fit into the circular groove 56 to form a seal between the mounting plate 52 and the pump housing 32. In addition, a rubber aperture seal 62, fitted into the circular groove 56, is also provided between the drive shaft aperture 60 and the mounting plate 52 to improve and maintain the seal therebetween.

Importantly, the drive shaft aperture 60 provides an opening in the pump housing 32 to allow the drive shaft assembly 26 to extend through the pump housing 32, from the drive mechanism 28 to the rotor 24. In order to maintain the pump housing 32 in proper position within the pump housing base 40, a pump housing retainer 44 is formed like a sleeve to fit over the exit port 38 of the pump housing 32. In order to engage the exit port 38, a header 64 is provided at one end of the pump housing retainer 44 so that as the same is urged toward the coupling seat 46, the pump housing 32 is tightly sandwiched between the coupling seat 46 and the pump housing retainer 44. In addition, a retainer seal 68 is provided between the header 64 and the exit port 38 of the pump housing 32 to help maintain a complete seal between the pump housing 32 and the pump housing retainer 44. Likewise, the retainer seal 68 fits into a circular groove 65 (FIG. 3) in order to maintain it in proper position.

With this construction, a threaded bore 66 can be formed through the header 64 to provide means for threaded engagement with a stator 22. Accordingly, a drive shaft assembly 26 can extend through the pump housing 32, from the coupling seat 46 of the pump housing base 40, to the stator 22 which is supported from the pump housing retainer 44. It should be noted however, that other configurations could serve equally as well. For example, the exit port 38 could be formed to define an interior threaded bore (not illustrated) to threadedly receive a stator.

Turning now to FIGS. 2 through 5 and 7, a pump housing base 40 is illustrated that includes a base frame 48 that extends from a coupling seat 46 to a retainer mounting portion 50. Importantly, the retainer mounting portion 50 is configured to receive and engage the pump housing retainer 44. For that purpose, the present invention incorporates an industry standard lever camloc type locking device to lock the pump housing retainer 44 to the pump housing base 40 to maintain the pump housing 32 within the pump housing base 40 in proper position.

Specifically, the retainer mounting portion 50 comprises opposing spaced apart male lever camloc(s) 72 mounted on either side of the retainer mounting portion 50. The male lever camloc(s) are mounted between spaced cam lugs 70 and held there by a pivot pin 71. In this way, a radially disposed camloc groove 74 can be formed on the outside of the pump housing retainer 44 for engagement with the male lever camloc(s) 72. Accordingly, this construction enables the male lever camloc (s) to move or pivot from a first open position where they are disingaged (not illustrated), to a second engaged position (FIG. 2) where the pump housing retainer 44 is locked to the pump housing base 40. As can be seen, each male lever camloc 72 defines a lobe 73 that provides the structure to engage with the camloc groove 74.

Figure 4:
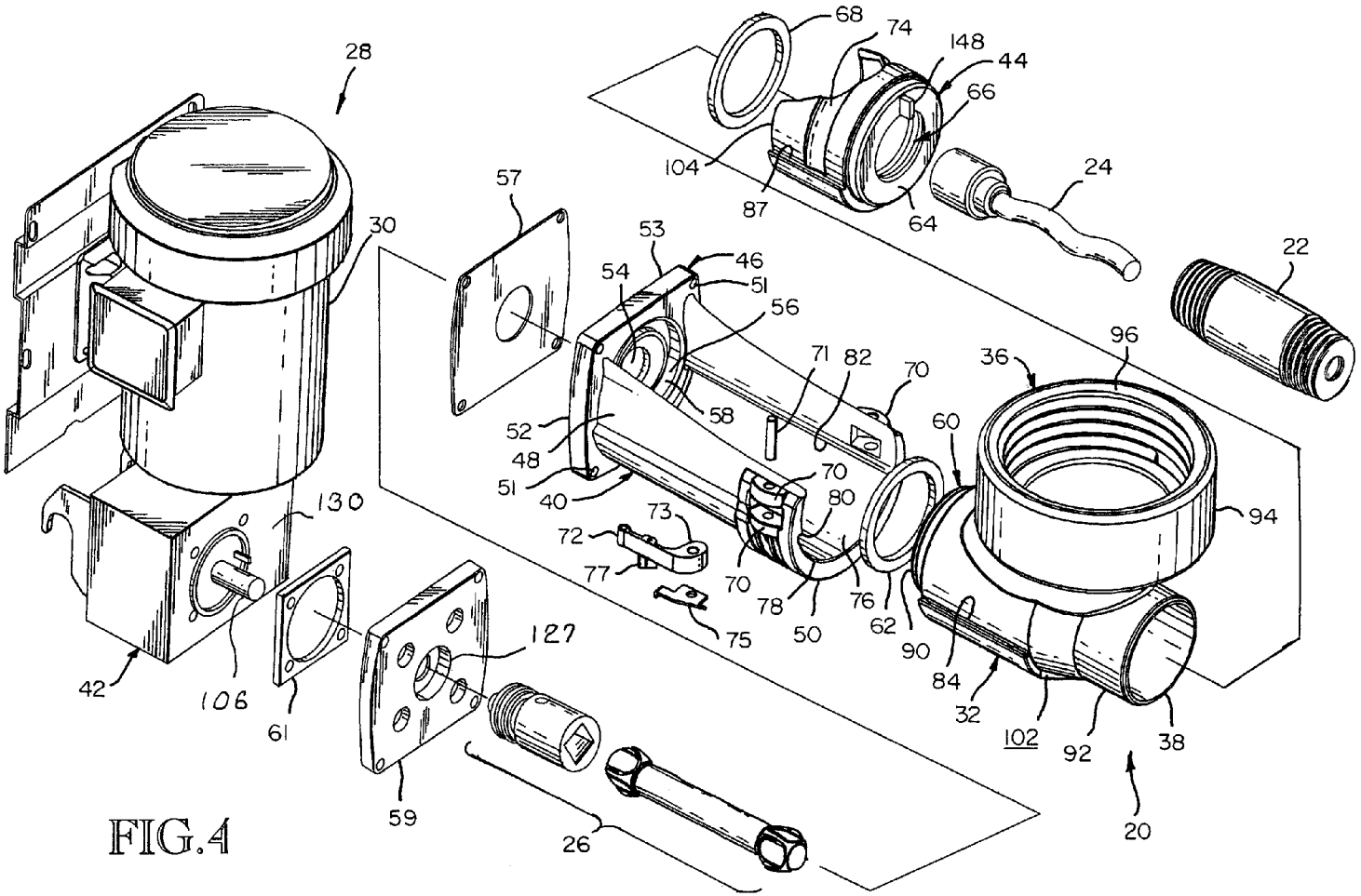
FIG. 4 is an exploded perspective view showing the components of a pump containment assembly and their location relative to a drive mechanism, a drive shaft assembly, and a stator type progressive cavity pump.
Figure 5:
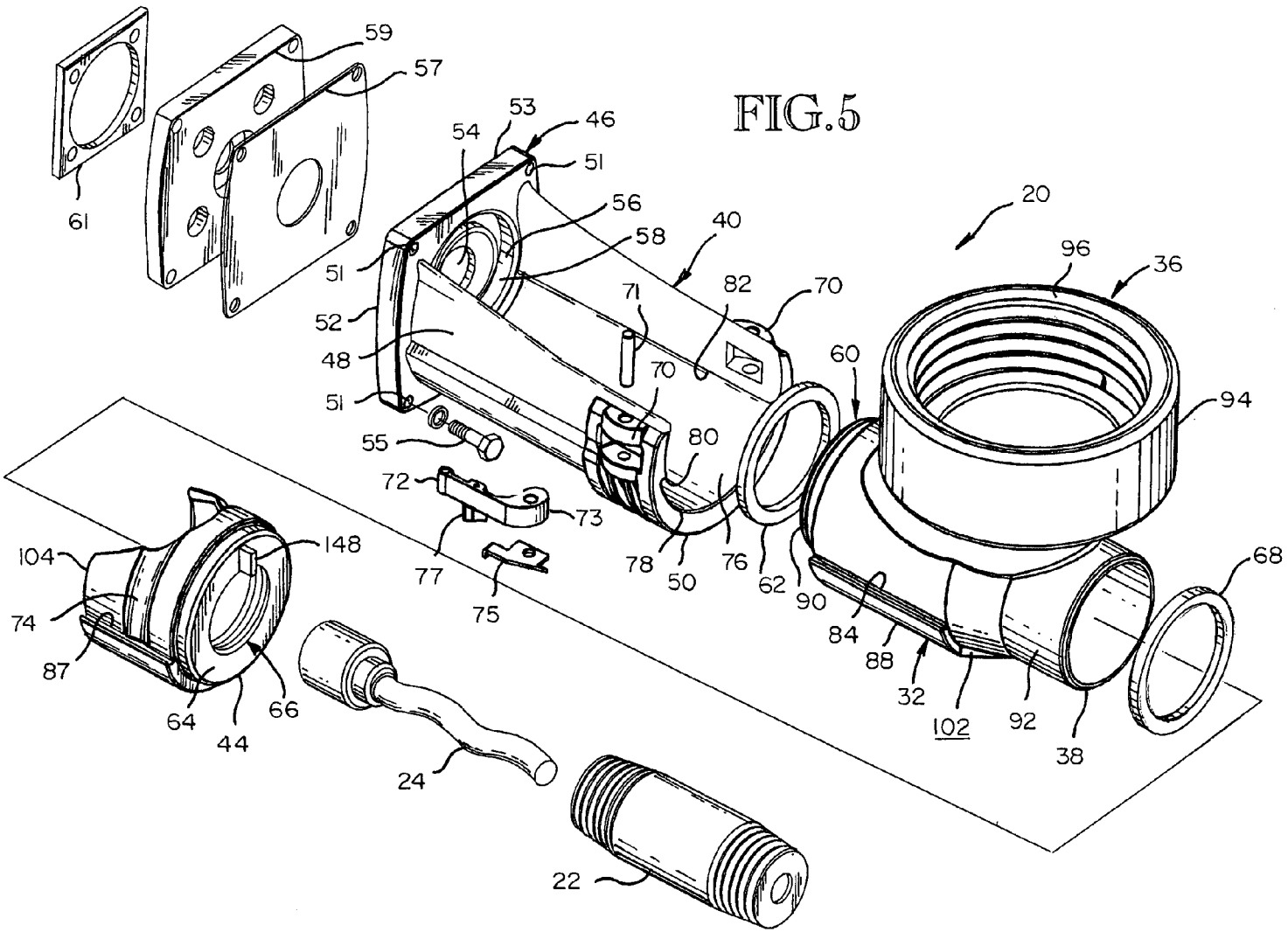
FIG. 5 is an exploded perspective view, similar to FIG. 4, illustrating the components of the pump containment assembly and their location in relation to other pump components

Further, as illustrated in FIGS. 4 and 5 a common cam loc latch 77, (as manufactured by PT Coupling—part number PT SL530), is employed to lock the lever cam loc 72 in the second closed position. As part of the locking mechanism, a com loc latch detent 75 is used as a brace between the cam loc latch 77 and the pump housing base 40.

In another aspect of the invention, it should be understood that the pump housing base 40, and the pump housing 32 are formed so that they can fit together in one way only, i.e., where the pump housing 32 is oriented inside the pump housing base 40 with a predetermined orientation, where the same are prevented from relative rotational movement. For this purpose, the pump housing base 40 is constructed to form a receiving slot 76 which is defined by a circular bottom portion 78 that extends radially from a first step 80 to a second step 82. As illustrated, the first and second steps 80 and 82 face downward.

Similarly, the pump housing 32 is formed to define two opposing upward facing lips 84 and 86 wherein a circular housing portion 88 is disposed between lips 84 and 86. Lips 84 and 86 are formed to mate with the pump housing base 40 such that the first step 80 is adjacent lip 84, and the second step 82 is adjacent lip 86 as the pump housing 32 mates with the pump housing base 40. In this way, the pump housing can slide into position within the pump housing base 40. Although the above noted configuration is employed in the present invention, many other configurations and designs (not illustrated) could be incorporated to created a one-way fit between the pump housing base 40 and the pump housing 32 where relative rotational movement is prevented. Similarly, the pump housing retainer 44 includes opposing retainer lips 87 and 89 so that it can be received, i.e. slide into the receiving slot 76, just in front of the pump housing 32.

Additionally, as disclosed in the illustrations, the pump housing 32 is constructed with opposing reduced diameter portions 90 and 92. In particular, reduced diameter portion 90 forms the drive shaft aperture 60, and reduced diameter portion 92 forms the exit port 38. In another possible configuration, the reduced diameter portion 92 could be formed to define a thrust surface 102 disposed to engage the rim 104 of the pump housing retainer 44. In this way, the pump housing retainer 44 could further urge the pump housing 32 toward the coupling seat 46 of the pump housing base 40 as the camloc(s) 72 are moved from the first to the second position.

Beyond this, the pump housing 32 includes an inlet port 36 as noted above. In the present invention, the inlet port 36 is constructed to define a mounting neck 94 that comprises a threaded bore 96. This threaded bore 96 is provided so that a hopper 98 with a threaded extension 100 can threadedly engage threaded bore 96 to properly secure the hopper 98 to the pump housing 32.

Figure 6:
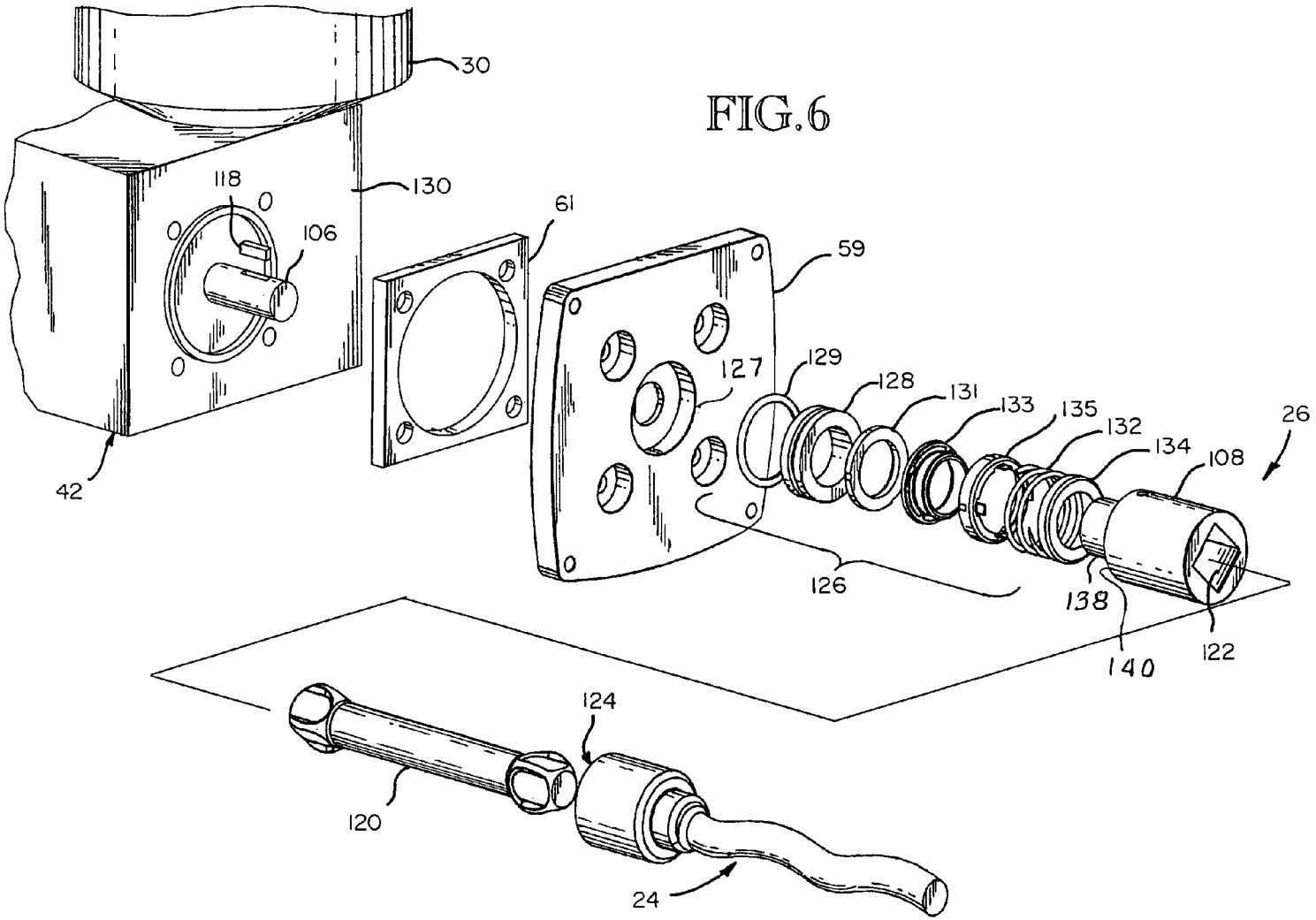
FIG. 6 is an exploded view of the components of a typical drive shaft assembly employed in a progressive cavity type spray system that incorporates a pump containment assembly.
Figure 7:
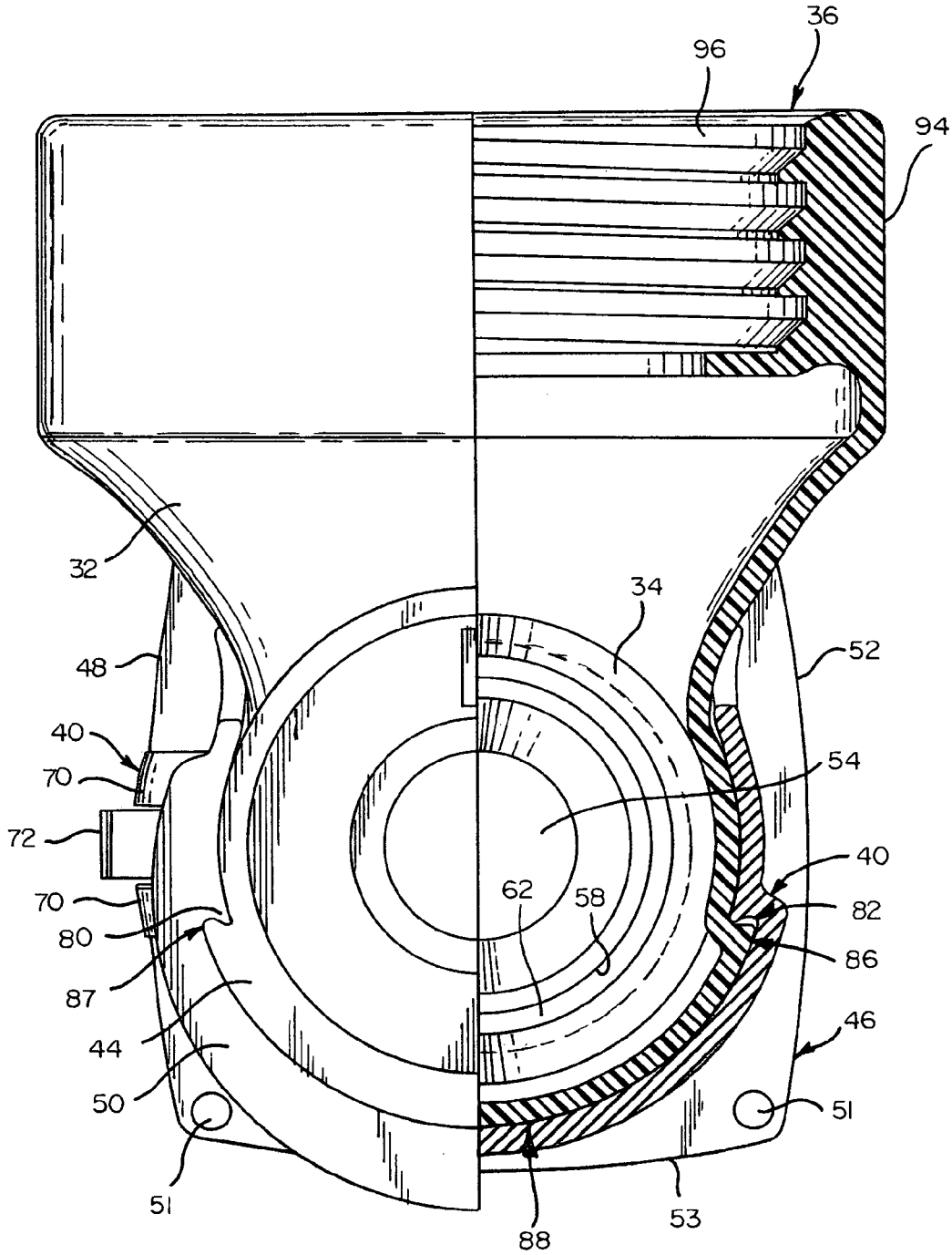
FIG. 7 is a sectional view taken along line 7-7 in FIG. 2.

Directing attention to FIG. 6, a typical drive shaft assembly 26 is illustrated. This drive shaft assembly 26 is similar to the one disclosed in U.S. Pat. No. 5,967,426 which is hereby incorporated by reference. The drive shaft assembly 26 comprises a plurality of components linked together, and extend from the transmission drive shaft 106 to the rotor 24. Connected to the transmission drive shaft 106, is a square drive coupler 108. The square drive coupler 108 is constructed to receive the transmission drive shaft 106, which includes a key 118, and is held in place by a set screw (not illustrated). In some applications, depending on the type of gear reducer/transmission 42 employed, a shim plate 61 may be required between the transmission flange 130 and the spacer plate 59.

The square drive coupler 108 also includes a drive socket 122 for receiving a connecting rod 120. In this way, the square drive coupler 108 can be connected to the rotor 24 by a connecting rod 120. One end of the connecting rod 120 fits into drive socket 122, the other end of the connecting rod 120 fits into a rotor socket 124 defined by the end portion of rotor 24 that lies within the containment chamber 34. It should be noted that the ends of connecting rod 120 are generally square in shape, with slightly rounded edges, so that the same can be received into similarly shaped square sockets of the rotor 24 and the square drive coupler 108, i.e., the drive socket 122 and the rotor socket 124. In addition, as best seen in FIG. 6, the opposing square ends of the connecting rod 120 are not aligned: they are twisted/rotated, relative to one another by 45 degrees.

It should be understood that when the spray system 18 is in operation, the thrust forces generated by the rotating rotor 24 pushing material out the stator 22 tend to urge the rotor 24 back toward the transmission 42. Accordingly, the connecting rod 120 is prevented from becoming disconnected. This method of coupling the connecting rod 120 to the square drive coupler 108 and the rotor 24 allows easy disassembly for repair or replacement of parts.

Because the liquid drywall material can travel into any cavity that is not sealed, an additional mechanical seal 126 is provided around the transmission drive shaft 106 as illustrated in FIG. 6. The mechanical seal 126 is a standard shaft-type seal manufactured by various manufacturers including Pac-Seal, Inc. In the preferred embodiment, the mechanical seal 126 is combined with the square drive coupler 108 thereby reducing the need for special parts to hold the mechanical seal 126 in place along the transmission drive shaft 106. As a result, the square drive coupler 108 performs as part of the transmission drive shaft 106 as well as a retainer/holder for the mechanical seal 126.

The mechanical seal 126 comprises a seal seat 128, with o-ring 129, disposed in a counter bore 127 formed in spacer plate 59. Accordingly, the mechanical seal 126 is disposed around the transmission drive shaft 106, abutting a spacer plate 59 which is disposed adjacent flange 53, with a gasket 57 disposed between the same. The seal seat 128 is urged toward the counter bore 127 by a spring 132 that is disposed between a spring retainer 134 and spring retainer 135. The spring retainer 134 fits over a reduced diameter portion 138 of the square drive coupler 108 and is urged against the shoulder 140 formed by the reduced diameter portion 138. The spring retainer 135 is thereby urged toward ring retainer 133 which, likewise, is urged against seal ring 131 with seal ring contacting seal seat 128. Although the thrust forces generated by the pump tend to keep the square drive coupler 108 engaged with the transmission drive shaft 106, a set screw (not illustrated) is employed through threaded bore (not illustrated) of the square drive coupler 108 against key 118.

Although the above noted drive shaft assembly 26 could be employed in the present invention, other drive shaft assemblies (not illustrated) could installed for this purpose with equal pumping performance.

Figure 2:
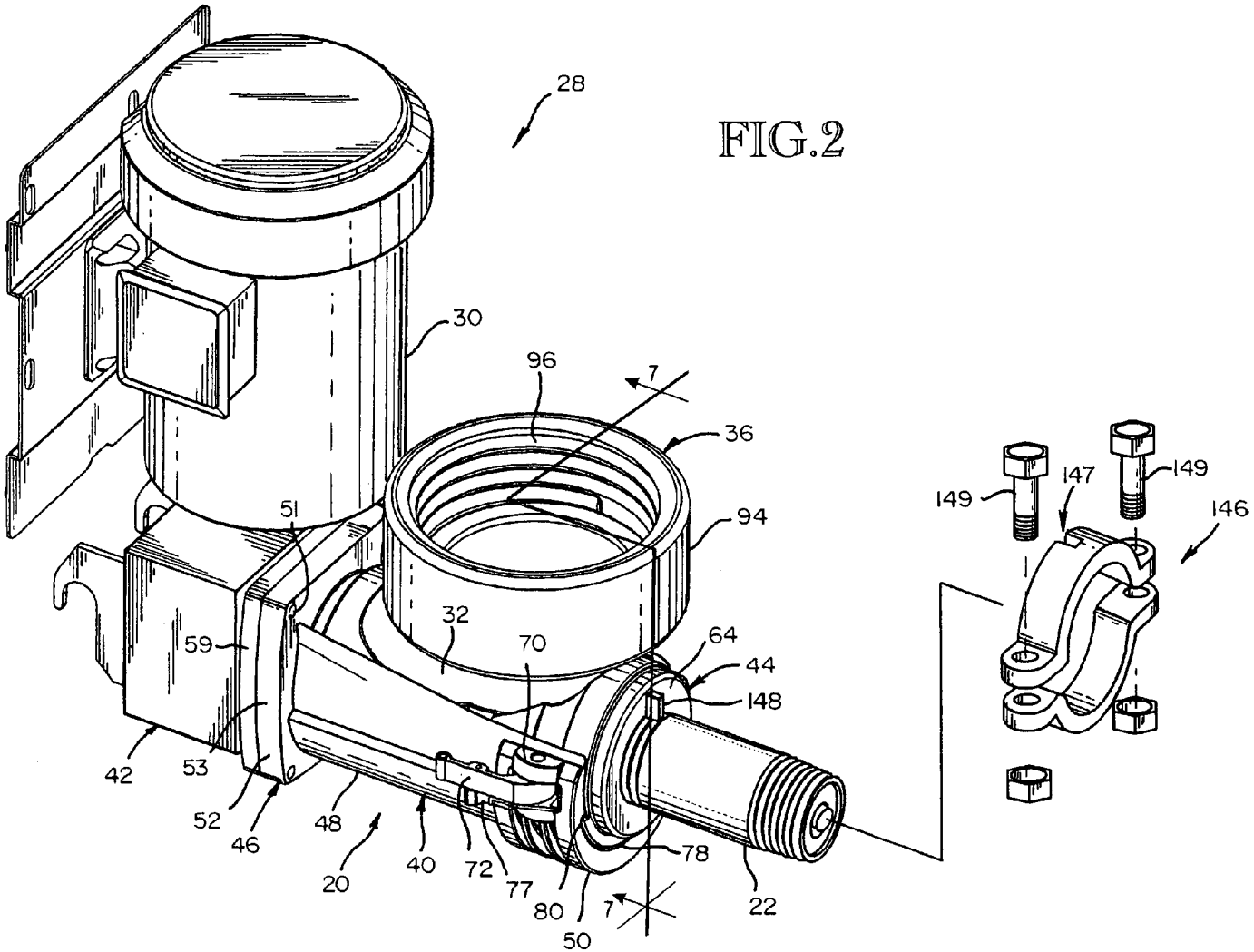
FIG. 2 is a perspective view showing a pump containment assembly that is mounted to a drive mechanism which includes an electric motor and a right angle gear reducer transmission.
Figure 3:
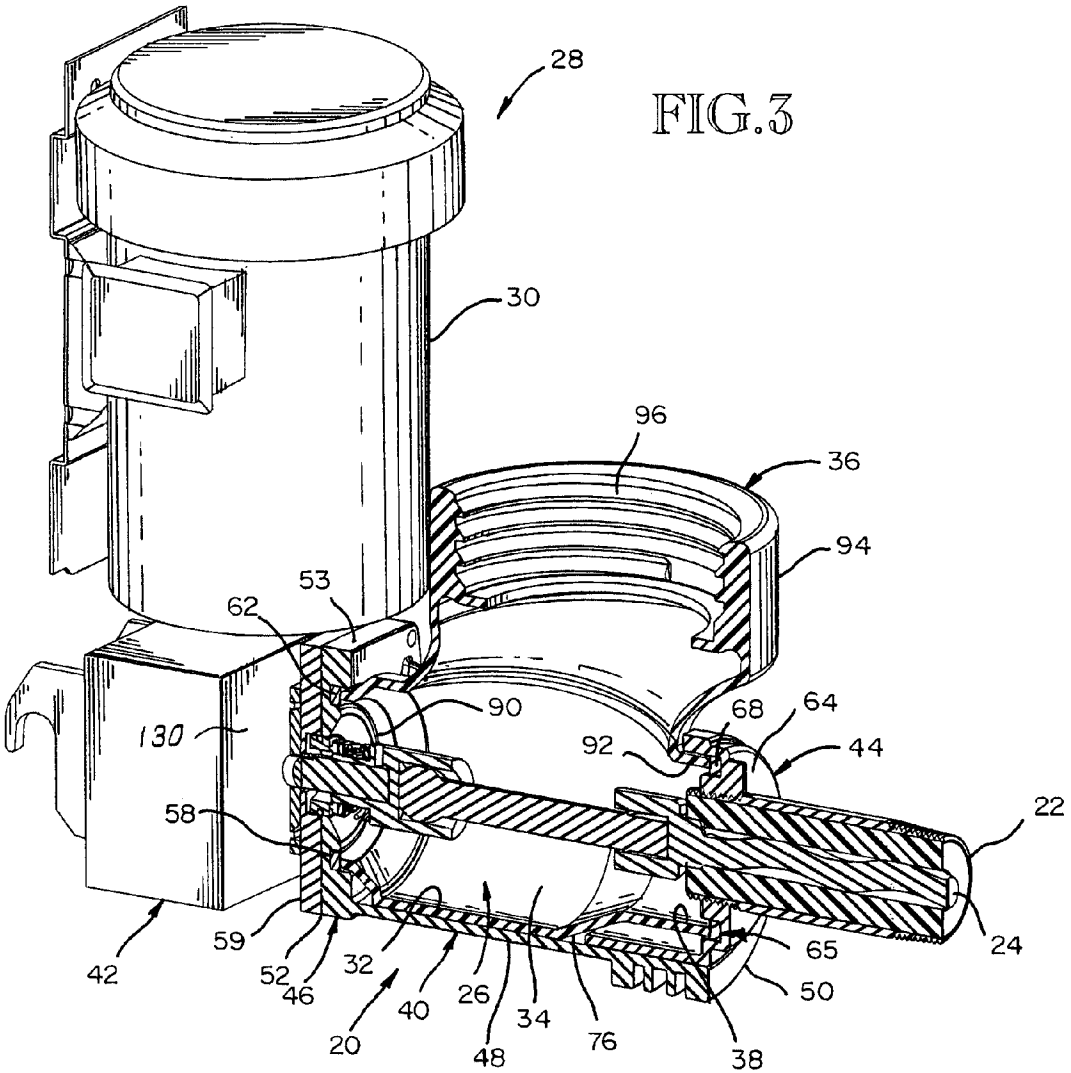
FIG. 3 is a perspective view, with portions broken away to show a pump containment assembly mounted to a drive mechanism, which includes an electric motor and a right angle gear reducer transmission with a drive shaft assembly extending from the transmission to a rotor disposed within a stator.

Directing attention to FIG. 2, a stator retainer 146 is illustrated for placement around stator 22. The stator retainer 146 includes a notch 147 which is disposed to engage retainer lug 148 which is integrally formedas part of the pump housing retainer. In this way, the stator retainer 146 can be clamped tightly around stator 22, with bolts 149, so that relative rotational movement between the stator 22 and the pump housing retainer 44 is prevented.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

That which is claimed is:

1. A knockdown pump containment assembly adapted for communication with a stator having a rotor disposed therein, the pump containment assembly comprising:

a pump housing defining a containment chamber for receiving, containing and directing the flow of a liquid material, the pump housing having an inlet port disposed for directing a flow of liquid material into the containment chamber, and an exit port for directing a flow of liquid material out of the containment chamber, into a stator, wherein the containment chamber of the pump housing is adapted to receive a drive shaft assembly therein;

a pump housing base for releasably receiving and supporting the pump housing;

a pump housing retainer releasably engagable with the pump housing base to releasably secure the pump housing to the pump housing base;

the pump housing base further comprising a coupling seat, and a base frame that extends outward from the coupling seat, to a retainer mounting portion thereof that receives and releasably fixes the pump housing retainer to the pump housing base so that the pump housing is releasably secured to the pump housing base between the coupling seat and the pump housing retainer; and means for fixing the alignment of the pump housing within the pump housing base.

2. A knockdown pump containment assembly adapted for communication with a stator having a rotor disposed therein, the pump containment assembly comprising:

a pump housing defining a containment chamber for receiving, containing and directing the flow of a liquid material, the pump housing having an inlet port disposed for directing a flow of liquid material into the containment chamber, and an exit port for directing a flow of liquid material out of the containment chamber, into a stator, wherein the containment chamber of the pump housing is adapted to receive a drive shaft assembly therein;

a pump housing base for releasably receiving and supporting the pump housing;

a pump housing retainer releasably engagable with the pump housing base to releasably secure the pump housing to the pump housing base;

the pump housing base further comprising a coupling seat, and a base frame that extends outward from the coupling seat, to a retainer mounting portion thereof that receives and releasably fixes the pump housing retainer to the pump housing base so that the pump housing is releasably secured to the pump housing base between the coupling seat and the pump housing retainer;

wherein the base frame defines a receiving slot extending along the base frame between the coupling seat and the retainer mounting portion for receiving the pump housing, and wherein the pump housing is formed to mate within the receiving slot of the base frame so that the pump housing alignment with the pump housing base is fixed, and relative rotational movement is restricted.

3. A pump containment assembly as recited in claim 2 wherein the pump housing retainer is formed to mate within the receiving slot of the base frame so that the alignment of the pump housing retainer with the pump housing base, and the pump housing is fixed.

4. A pump containment assembly as recited in claim 3 wherein the receiving slot of the base frame is defined by a circular bottom portion disposed between a first step and a second step that extends along the base frame between the coupling seat and the retainer mounting portion.

5. A pump containment assembly as recited in claim 4 wherein the pump housing is formed to define a circular housing portion disposed between a first lip and a second lip, wherein the first lip is disposed for sliding engagement with the first step of the base frame, and the second lip is disposed for sliding engagement with the second step of the base frame, wherein relative rotational movement between the pump housing and the pump housing base is restricted so that their relative alignment is fixed.

6. A pump containment assembly as recited in claim 4 wherein the pump housing retainer is formed to define spaced apart retainer lips disposed to respectively engage the first and second steps of the base frame to restrict relative rotational movement between the pump housing retainer and the pump housing base so that their relative alignment is fixed.

7. A knockdown pump containment assembly adapted for communication with a stator having a rotor disposed therein, the pump containment assembly comprising:

a pump housing defining a containment chamber for receiving, containing and directing the flow of a liquid material, the pump housing having an inlet port disposed for directing a flow of liquid material into the containment chamber, and an exit port for directing a flow of liquid material out of the containment chamber, into a stator, wherein the containment chamber of the pump housing is adapted to receive a drive shaft assembly therein;

a pump housing base for releasably receiving and supporting the pump housing;

a pump housing retainer releasably engagable with the pump housing base to releasably secure the pump housing to the pump housing base;

the pump housing base further comprising a coupling seat, and a base frame that extends outward from the coupling seat, to a retainer mounting portion thereof that receives and releasably fixes the pump housing retainer to the pump housing base so that the pump housing is releasably secured to the pump housing base between the coupling seat and the pump housing retainer; and wherein the pump housing retainer comprises a threaded bore for threadedly engaging a stator.

8. A knockdown pump containment assembly adapted for communication with a stator having a rotor disposed therein, the pump containment assembly comprising:

a pump housing defining a containment chamber for receiving, containing and directing the flow of a liquid material, the pump housing having an inlet port disposed for directing a flow of liquid material into the containment chamber, and an exit port for directing a flow of liquid material out of the containment chamber, into a stator, wherein the containment chamber of the pump housing is adapted to receive a drive shaft assembly therein;

a pump housing base for releasably receiving and supporting the pump housing;

a pump housing retainer releasably engagable with the pump housing base to releasably secure the pump housing to the pump housing base;

the pump housing base further comprising a coupling seat, and a base frame that extends outward from the coupling seat, to a retainer mounting portion thereof that receives and releasably fixes the pump housing retainer to the pump housing base so that the pump housing is releasably secured to the pump housing base between the coupling seat and the pump housing retainer; and wherein at least one lever cam bc is disposed on the retainer mounting portion for engagement with the pump housing retainer to releasably fix the pump housing retainer to the pump housing base so that the pump housing is releasably secured to the pump housing base between the coupling seat and the pump housing retainer.

9. A method for making knockdown pump containment assembly adapted for communication with a stator having a rotor disposed therein, the method comprising the steps:

forming a pump housing that defines a containment chamber for receiving, containing and directing the flow of a liquid material, the pump housing having an inlet port disposed for directing a flow of liquid material into the containment chamber, and an exit port for directing a flow of liquid material out of the containment chamber, into a stator, wherein the containment chamber of the pump housing is adapted to receive a drive shaft assembly therein;

providing a pump housing base for releasably receiving and supporting the pump housing;

providing a pump housing retainer releasably engagable with the pump housing base to releasably secure the pump housing to the pump housing base;

wherein the step of providing a pump housing base further comprises the steps of forming a coupling seat, and a base frame that extends outward from the coupling seat to a retainer mounting portion formed to receive and releasably fix the pump housing retainer to the pump housing base so that the pump housing is releasably secured to the pump housing base between the coupling seat and the pump housing retainer; and providing means for fixing the alignment of the pump housing within the pump housing base.

10. A method of making a pump containment assembly as recited in claim 9 wherein the step of forming a base frame further comprises the step of forming a receiving slot extending along the base frame between the coupling seat and the retainer mounting portion for receiving the pump housing, and wherein the pump housing is formed to mate within the receiving slot of the base frame so that the pump housing alignment with the pump housing base is fixed, and relative rotational movement is restricted.

11. A method of making a pump containment assembly as recited in claim 10 wherein the pump housing retainer is formed to mate within the receiving slot of the base frame so that the alignment of the pump housing retainer with the pump housing base, and the pump housing is fixed.

12. A knockdown pump containment assembly adapted for communication with a stator having a rotor disposed therein, the pump containment assembly comprising: a pump housing defining a containment chamber for receiving, containing and directing the flow of a liquid material, the pump housing having an inlet port disposed for directing a flow of liquid material into the containment chamber, and an exit port for directing a flow of liquid material out of the containment chamber, into a stator, wherein the containment chamber of the pump housing is adapted to receive a drive shaft assembly therein;

a pump housing base for releasably receiving and supporting the pump housing;

a pump housing retainer releasably engagable with the pump housing base to releasably secure the pump housing to the pump housing base;

the pump housing base further comprising a coupling seat, and a base frame that extends outward from the coupling seat, to a retainer mounting portion thereof that receives and releasably fixes the pump housing retainer to the pump housing base so that the pump housing is releasably secured to the pump housing base between the coupling seat and the pump housing retainer;

means for fixing the alignment of the pump housing within the pump housing base; and wherein the pump housing further comprises a drive shaft aperture adapted to receive a drive shaft assembly therethrough.

13. A pump containment assembly as recited in claim 12 wherein the pump housing retainer comprises a threaded bore for threadedly engaging said stator.

14. A pump containment assembly as recited in claim 12 wherein a lever cam bc disposed on the retainer mounting portion engages the pump housing retainer to releasably fix the pump housing retainer to the pump housing base so that the pump housing is releasably secured to the pump housing base between the coupling seat and the pump housing retainer.

15. A pump containment assembly as recited in claim 14 wherein the drive shaft aperture forms a seal with the coupling seat of the pump housing base.

16. A pump containment assembly as recited in claim 12 wherein the inlet port of the containment chamber defines a threaded bore for threadedly engaging a liquid supply hopper.

17. A pump containment assembly as recited in claim 12 wherein the pump housing retainer includes a retainer lug for engagement with a stator to prevent rotation of the stator in relation to the pump housing retainer.

* * * * *